United States Patent [19]

Sanchez

[11] 4,219,238

[45] Aug. 26, 1980

[54] COMPOSITION ROOF SHINGLE REMOVER

[76] Inventor: Edward J. Sanchez, 727 Richland Ave., Baton Rouge, La. 70806

[21] Appl. No.: 953,411

[22] Filed: Oct. 23, 1978

[51] Int. Cl.[2] ..... E04D 15/00

[52] U.S. Cl. ..... 299/39

[58] Field of Search ..... 299/39–41

[56] References Cited

U.S. PATENT DOCUMENTS

| | | | |
|---|---|---|---|
| 1,415,949 | 5/1922 | Perelman | 299/39 |
| 2,314,934 | 3/1943 | Guernsey | 299/40 X |
| 2,545,827 | 3/1951 | Posey | 299/39 X |
| 2,576,607 | 11/1951 | Knudson et al. | 299/39 |
| 3,156,231 | 11/1964 | Harding | 299/39 |

*Primary Examiner*—Ernest R. Purser

*Attorney, Agent, or Firm*—Roy, Kiesel, Patterson & Abadie

[57] ABSTRACT

A power driven device for removing roof shingles from roofs is disclosed having angled shingle remover bars mounted on a rotary driven reel.

8 Claims, 4 Drawing Figures

FIGURE 1
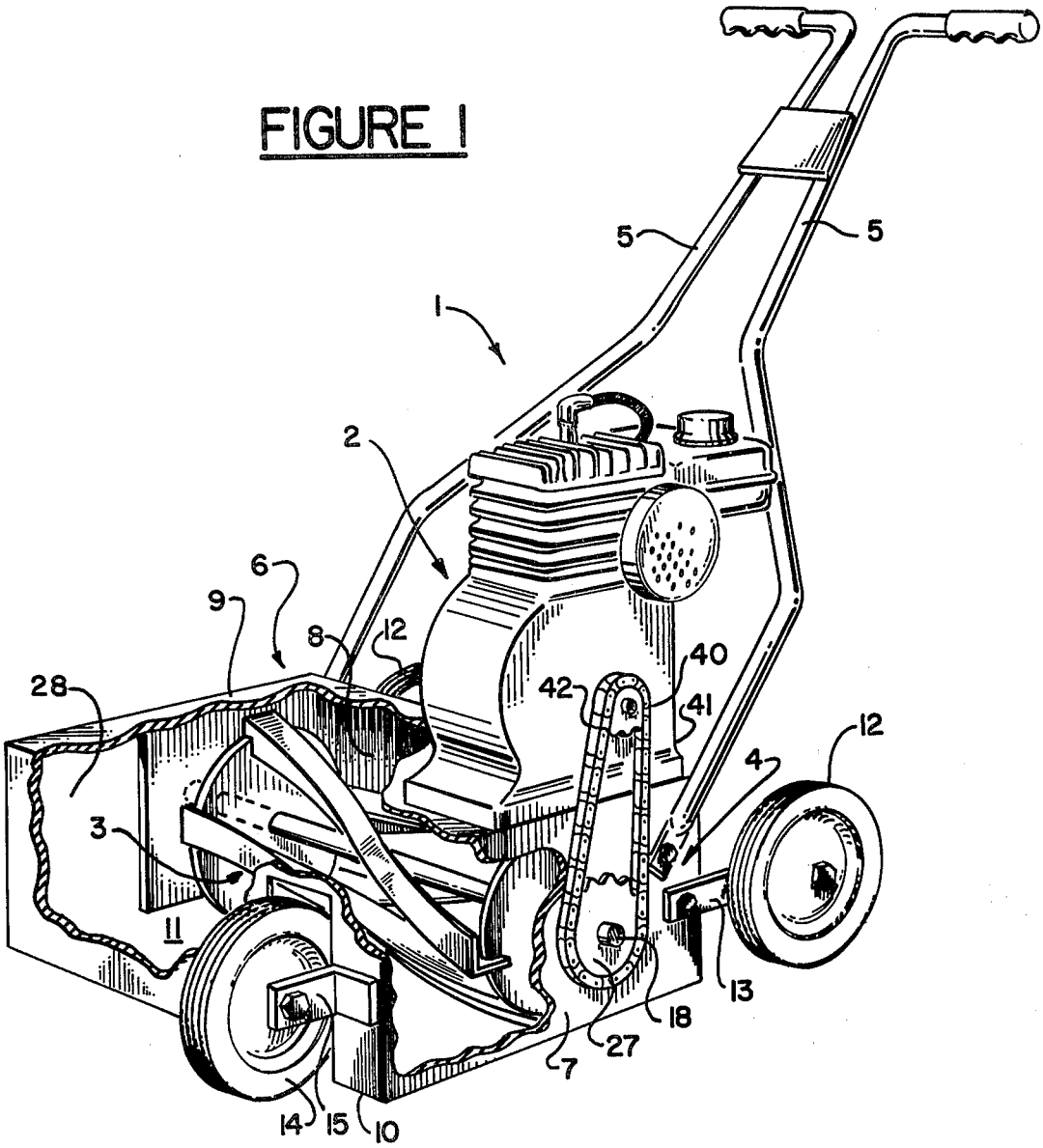
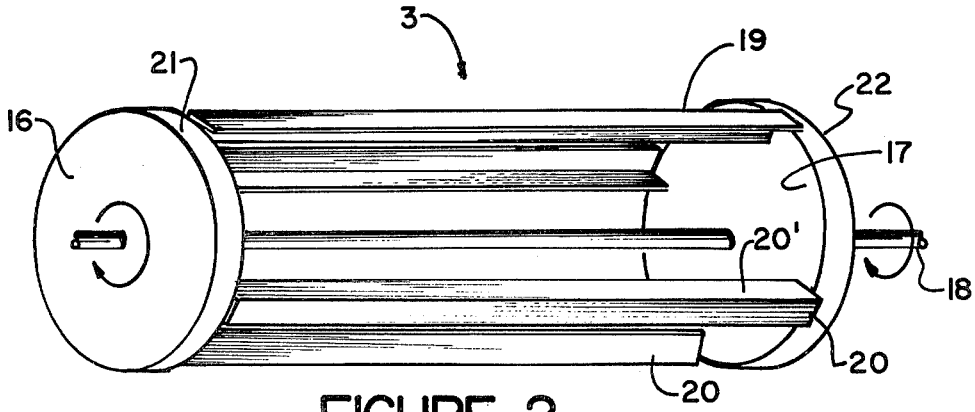
FIGURE 2

COMPOSITION ROOF SHINGLE REMOVER

BACKGROUND OF THE INVENTION

1. Field of the Invention

This invention relates broadly to power driven devices and more particularly to power driven devices for removal of roof shingles from building structures.

2. Prior Art

Most residential homes and some commercial buildings employ asphalt roof shingles on their roofs. As these shingles wear out, they must be removed and replaced in order to avoid water leakage into the buildings. The problem of how to remove effectively and efficiently these old shingles has been studied by the housing industry for some time. Examples of various eariler machines developed for this purpose can be seen in Perelman U.S. Pat. No. 1,415,949 issued May 16, 1922, and entitled "Roof Scraping Machine", and in Libertini U.S. Pat. No. 1,949,482 issued Nov. 6, 1933, and entitled "Scraping Machine". However, for various reasons, prior attempts to develop and effective and efficient device have not been successful. Therefore, at present, these old shingles are being removed by hand with the help of hammers and small crowbars. Although roof shingles can be removed in this manner, this procedure is quite slow and very expensive.

SUMMARY OF THE INVENTION

Therefore, one object of this invention is to provide a device which can easily and quickly remove roof shingles from building roofs.

Another object of this invention is to provide a power driven device which can remove roof shingles from building roofs.

Other objects and advantages of this invention will become apparent from the ensuing descriptions of the invention.

Accordingly, a power driven device for removing roof shingles from a roof is provided having a power source mounted on a frame assembly, a drive means attaching the power source and a reel assembly for causing the the reel assembly to rotate about an axle, the reel assembly having shingle remover bar support plates mounted on opposite ends of the axle and shingle remover bars attached to the plates wherein the remover bars are formed by angled metal strips having a section protruding past said plates at an angle to make contact with the roof shingles.

BRIEF DESCRIPTION OF THE DRAWINGS

FIG. 1 is a cutaway side perspective view of one embodiment of the invention.

FIG. 2 is a perspective view of another embodiment of the reel assembly.

PREFERRED EMBODIMENTS OF THE INVENTION

Figure 3:
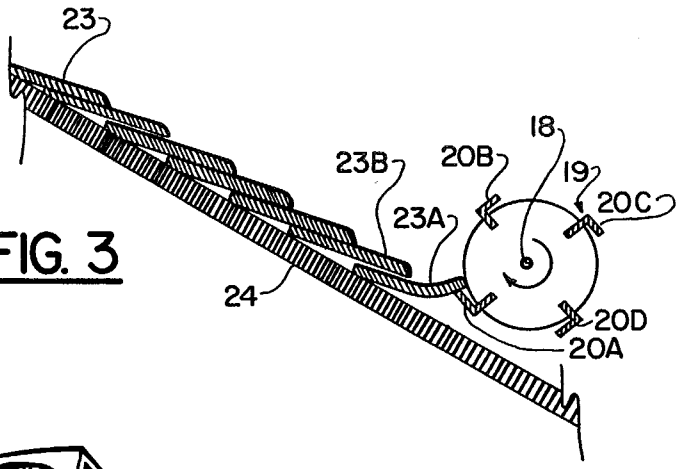
FIG. 3 is a cross-sectional view of the reel assembly in position on a shingled roof.

Referring to FIG. 1, a preferred embodiment of the roof shingle removing device of this invention is shown comprising the general elements of a frame assembly 1, a power source 2 mounted on frame assembly 1, and a reel assembly 3 connected to power source 2 by drive means 4.

More particularly, frame structure 1 will comprise handle bars 5 attached to a reel housing assembly 6 having side walls 7 and rear wall 8 and top wall 9 forming, in conjunction with frontal hood 10, a cavity 11 in which reel assembly 3 is positioned as shown.

In a preferred feature, frame assembly 1 is provided with rear wheels 12 mounted to the reel housing assembly 6 by connecting plate 13. In a still more preferred embodiment, frontal guide wheel 14 is also attached to the reel housing assembly 6 by connecting plate member 15. Referring now to FIG. 2, one preferred embodiment of reel assembly 3 comprises parallel remover bar support plates 16 and 17 attached to axle 18 by screw 39 that screws into threaded opening 38 and matching opening in axle 18 (not shown) and spaced apart in position by shingle removal bars 19. Shingle removal bars 19 each have support sections 20′ perpendicularly connected to rigid straight shingle remover section 20 which extends and protrudes past remover bar support plate edges 21 and 22 a sufficient distance to contact shingles 23 when the roof shingle remover is sitting in position on a roof surface. In a preferred feature, shingle remover section 20 protrudes past plate edges 21, 22 at an angle and direction of remover bar support plates 16 and 17 rotary motion.

Figure 4:
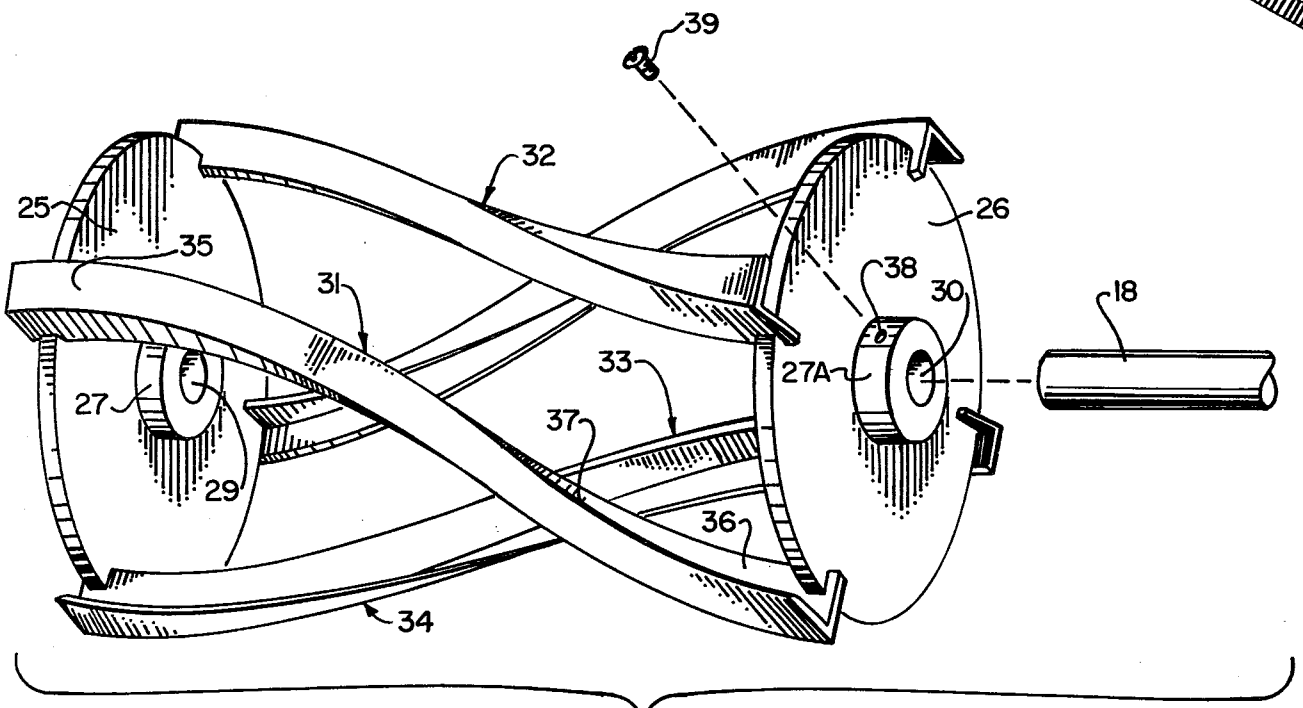
FIG. 4 is a perspective view of a preferred embodiment of the reel assembly shown in FIG. 1.

In a more preferred embodiment as shown in FIG. 4, reel assembly 3 comprises support plates 25, 26, each having shoulder members 27, 27*a*, respectively, provided with openings 29, 30, respectively, for receiving axle 18. Rigidly fixing support plates 25, 26 parallelly apart are shingle remover bars 31, 32, 33 and 34. Each shingle remover bar comprises a shingle remover section 35 and angularly attached thereto are support section 36 welded or otherwise attached to plates 25, 26. In this preferred embodiment, both sections are angularly curved between support plates 25, 26 so that only part of shingle remover section edge 37 makes contact with the roof. Edge 37 extends between and out from support plates 25, 26 at an angle and in the direction of the rotation.

While the number of shingle remover bars can vary, it is preferred that only three to six be employed. This allows sufficient space between the bars for the lifted shingles to pass, yet provides for smoother, less jerky operation of the apparatus.

In operation of one embodiment of this invention, the shingle remover device is placed on the roof whereby shingle remover section 20 contacts shingles 23. Power source 2 (e.g., gasoline driven piston engine) is engaged causing axle 40 to rotate. Belt 41 of drive means 4 connects sprocket 42 attached to axle 40 to sprocket 27 attached to axle 18 causing axle 18 to turn. Axle 18 is mounted between side walls 7 and extends through wall openings (not shown) in a conventional manner to allow rotation thereof. As reel assembly 3 rotates, shingle remover section 20 slips under shingle 23 lifting shingle 23 upward and from roof 24. Shingle 23 is torn and ripped up as it passes around reel assembly 3 in cavity 11 until it is forced out opening 28 in frontal hood 10.

The lifting of shingle 23A (see FIG. 3) off roof 24 causes the next overlapping shingle 23B to be raised enough so that one of straight members 20A, 20B, 20C and 20D can get underneath it and in similar manner lift it off the roof.

In similar fashion, shingle remover sections 37 also remove shingles 23 from roof 24. However, because of the angular, curved feature of sections 37, there is a more gradual transition in removal action from one section 37 to the next. This transitional movement results in substantial reduction in the jerkiness of the machine operation and more efficient, effective removal of the roof shingles.

There are, of course, various embodiments and alternate designs, such as the use of dual parallel cutting assemblies, rotary or reel type action, etc., which are included in the scope of this invention as defined by the following claims.

What I claim is:

1. A power driven device for removing roof shingles from a roof which comprises:

(a) a frame assembly;

(b) a power source mounted on said frame assembly; and (c) a reel assembly connected to said power source by a drive means for providing rotary motion to said reel assembly, said reel assembly having an axle with drive means engaging members, remover bar support plates fixedly mounted on opposite end sections of said axle and extending outward from said axle, and shingle remover bars spaced apart and attached to and extending between said plates at a distance from said axle to form an opening between said shingle remover bars and said axle for said roof shingles to pass through, said remover bars protruding past said plates a sufficient distance to contact said shingles at an angle in direction of said plate's rotary motion.

2. A device according to claim 1 wherein said frame structure comprises:

(a) a reel housing assembly including side, rear and top walls connected together about the sides, rear and top of said reel assembly;

(b) a frontal hood attached to said housing, said hood having panels extending in front of said reel assembly, said panels having an opening in front of and to one side of said reel assembly through which removed shingles can pass.

3. A device according to claim 2 wherein guide wheels are attached to said reel housing assembly.

4. A device according to claim 2 wherein a frontal guide wheel is attached to said reel housing assembly structure.

5. A device according to claim 2 wherein handle bars are attached to said housing assembly and extend upward at an angle in direction of said plates' rotary motion.

6. A device according to claim 1 wherein said remover bars are metal bars having a straight member extending between said plates with one of its edges extending past said plates a sufficient distance to contact said roof shingles.

7. A device according to claim 1 wherein said remover bars comprise a remover section angularly attached to a support section, said sections angularly curved between and attached to said support plates.

8. A device according to claim 7 wherein there are three to six remover bars.

* * * * *